US006874664B1

(12) United States Patent
Montgomery

(10) Patent No.: US 6,874,664 B1
(45) Date of Patent: Apr. 5, 2005

(54) PUSH-PULL DISPENSER WITH FOLDING FINGERS

(75) Inventor: Gary V. Montgomery, Evansville, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 420 days.

(21) Appl. No.: 10/163,203

(22) Filed: Jun. 5, 2002

(51) Int. Cl.[7] ..... B67D 3/00
(52) U.S. Cl. ..... 222/525; 222/522
(58) Field of Search ..... 222/519–521, 222/522, 525

(56) References Cited

U.S. PATENT DOCUMENTS 1,920,199 A * 8/1933 Jesnig ..... 222/521
1,977,623 A * 10/1934 Corbin, Jr. ..... 222/521
2,017,140 A * 10/1935 Worth ..... 222/521
2,582,026 A 1/1952 Friedman
2,621,832 A 12/1952 Friedman
5,104,008 A * 4/1992 Crisci ..... 222/525
5,465,876 A * 11/1995 Crisci ..... 222/525
5,472,120 A 12/1995 Stebick et al.
5,588,562 A 12/1996 Sander et al.
5,979,716 A * 11/1999 May ..... 222/520
6,286,733 B1 * 9/2001 Francois ..... 222/525
6,357,635 B1 3/2002 Pagliaro et al.
6,568,566 B2 * 5/2003 Smith ..... 222/525

* cited by examiner

*Primary Examiner*—Kenneth Bomberg
(74) *Attorney, Agent, or Firm*—James E. Cole; Middleton Reutlinger

(57) ABSTRACT

A push-pull dispenser is shown having a base portion, an upwardly extending neck portion, a stem extends upwardly from the neck and has at least one stem lug depending from an upper portion of the stem. The stem lug may have four sides including an upper tapered or beveled surface and a lower horizontal surface. The push-pull dispenser also comprises a slidable dispensing cap disposed over the stem and at least one folding finger extending upwardly from a lower portion of the slidable dispensing cap. The at least one folding finger has an upper horizontal surface which engages the lower horizontal surface of the stem lug and inhibits resultant forces which typically cause slidable dispensing caps to deflect.

21 Claims, 6 Drawing Sheets

PUSH-PULL DISPENSER WITH FOLDING FINGERS

BACKGROUND OF THE INVENTION

1. Technical Field of the Invention

The present invention relates generally to push-pull type dispenser. More specifically, the present invention relates to a push-pull type dispenser having a folding finger positioned on an inner surface of a slidable dispensing cap, the folding finger being designed to inhibit removal of the slidable dispensing cap from the dispenser.

2. Description of the Related Art

Typical push-pull designs have often used interference beads disposed along an inner surface of the sliding cap and an outer surface of the stem to prevent the cap from being pulled from the stem. Due to the rounded design of typical interference beads, for example the ribs shown in U.S. Pat. No. 5,328,063, those cap beads can often be pulled over the stem interference bead with little force. This is due to the resultant force caused by a combination of the vertical pulling force by a user and contact along angled surfaces of the interference beads which forces the cap to deflect outward and over the stem bead.

In view of the push-pull dispensers currently known, it is preferable to have a push-pull dispenser design having a folding finger on a slidable dispensing cap wherein the folding finger has a horizontal surface which contacts a horizontal surface of an interference bead such that the sliding cap is inhibited from being removed.

SUMMARY OF THE INVENTION

It is an objective of the present invention to provide a push-pull dispenser.

It is a further objective of the present invention to provide a push-pull dispenser having a folding finger hingeably connected to a slidable dispensing cap along a lower peripheral edge of the slidable dispensing cap.

It is an still a further objective of the present invention to provide a push-pull dispenser having a stem mounted rib for engaging the folding finger wherein the stem mounted rib and folding finger engage along horizontal surfaces.

It is yet an even further objective of the present invention to provide the rib and folding finger with a substantially horizontal engaging surfaces in order to inhibit angular resultant forces.

In particular, the push-pull dispenser comprises a base portion having an annular sidewall including an outer surface and an inner surface. The inner surface of the sidewall may have a helical thread circumferentially extending about the inner surface to engage a neck finish. The base portion further comprises a base portion top wall having a dispensing orifice therein for dispensing fluid from within a container. The base portion top wall also has a flexible folding seal element for compressively sealing against a container top wall.

Extending above the base portion top wall and circumscribing the base portion dispensing orifice is a stem. The stem has a hollow cylindrical shape and is in fluid communication with the base portion and a container disposed therebeneath. At an upper end of the stem is a stem lug which, in section, may have four sides including a substantially horizontal lower surface and a tapered or beveled upper surface. The stem lug may be molded in a first upper position and pushed down to a lower position for use.

Centrally disposed within an upper portion of the stem is a flow diverter. The flow diverter works in cooperation with a slidable dispensing cap to open and close the fluid communication path through the push-pull dispenser.

Slidably connected to the stem is a slidable dispensing cap, being substantially cylindrical in shape and having a finger rib circumscribing an upper portion of the cap. The cap further comprises an upper surface or cap top wall having a cap-dispensing aperture therein. The cap dispensing aperture is in fluid communication with the stem and a container disposed beneath the dispenser. Depending from the cap top wall and defining the dispensing aperture is an annular valve finger which engages the stem. At a lower end of the slidable dispensing cap, is at least one folding finger. The at least one folding finger may be either a continuous folding finger or a plurality of folding fingers. The at least one folding finger have a substantially horizontal upper surface which engages the lower horizontal rib surface. Since these two engaging or abutting surfaces are substantially horizontal there is no resultant force which causes the slidable dispensing cap sidewall to deflect in a radially outward manner. The at least one folding finger is preferably disposed in an upwardly and inwardly extending manner and between the inner surface of the slidable dispensing cap and the outer surface of the stem.

A flow diverter is centrally disposed in the stem. This design defines an inner fluid communication path through the base portion, neck, stem, and cap dispensing aperture. When the slidable dispensing cap is slidably disposed in a downward position, the annular valve finger extending from the cap top wall engages the stem thereby closing a fluid communication path. When the slidable dispensing cap is disposed in an upper position the fingers disengage from the stem lug opening the fluid communication path for dispensing. In this position fluids from the container may be disposed to a user as desired.

All of the above outlined objectives are to be understood as exemplary only and many more objectives of the invention may be learned from the disclosure herein. Therefore, no limiting interpretation of the objectives noted is to be understood without further reading of the entire specification, claims, and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 1:
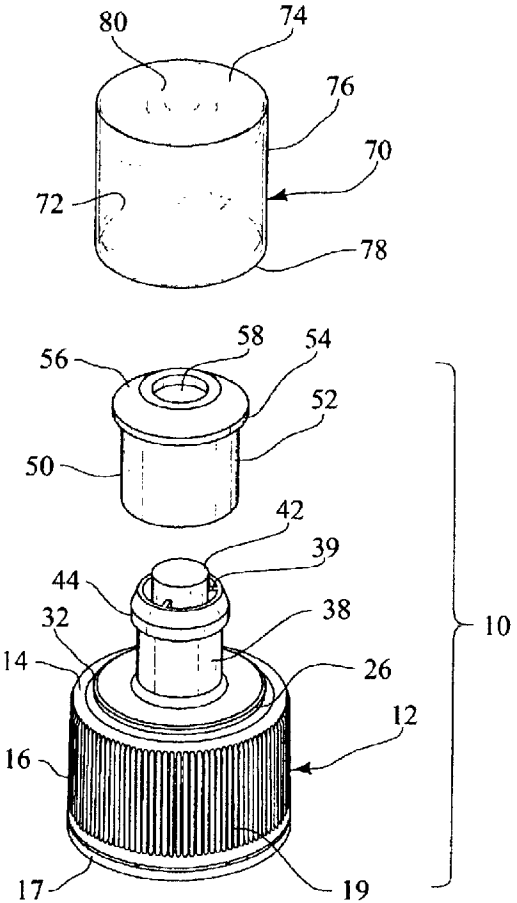
FIG. 1 shows an assembly view of the push-pull dispenser of the present invention.
Figure 3:
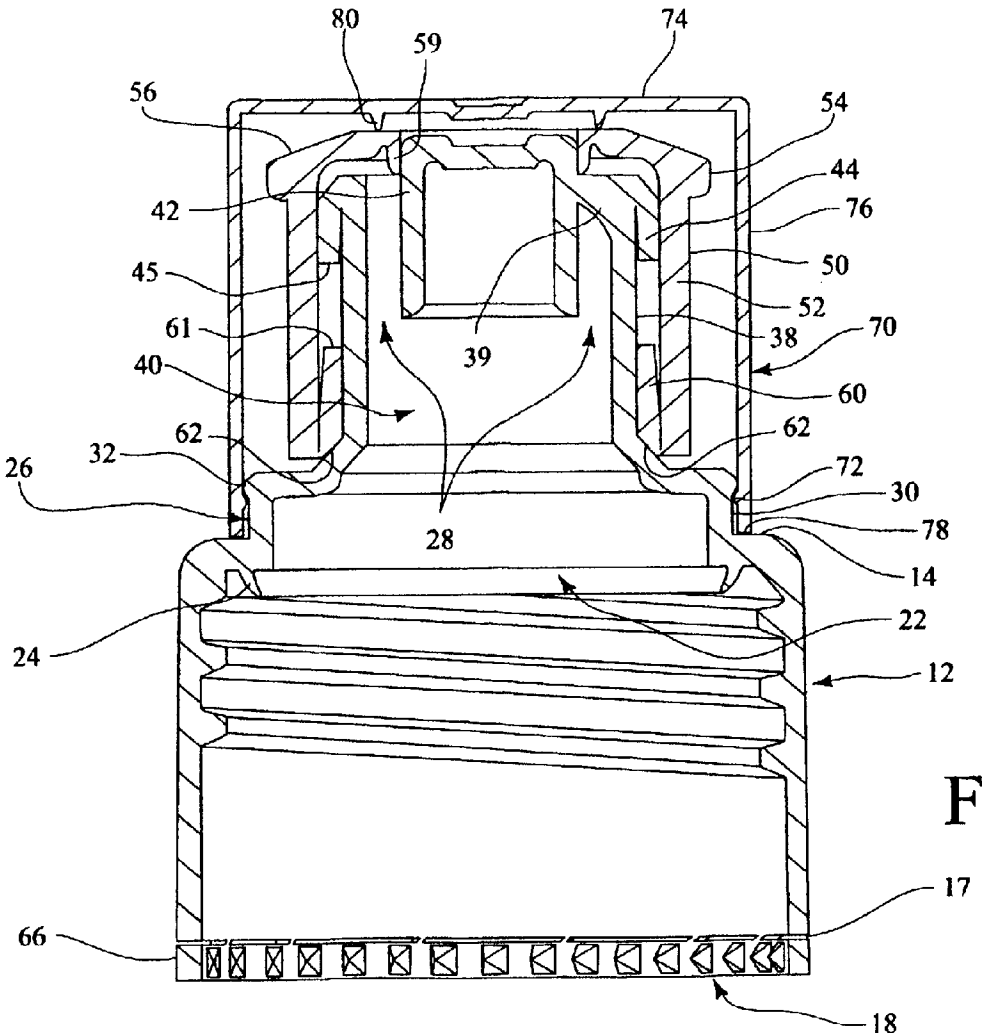
FIG. 3 shows a sectional view of the push-pull dispenser of FIG. 1 in the closed position.
Figure 4:
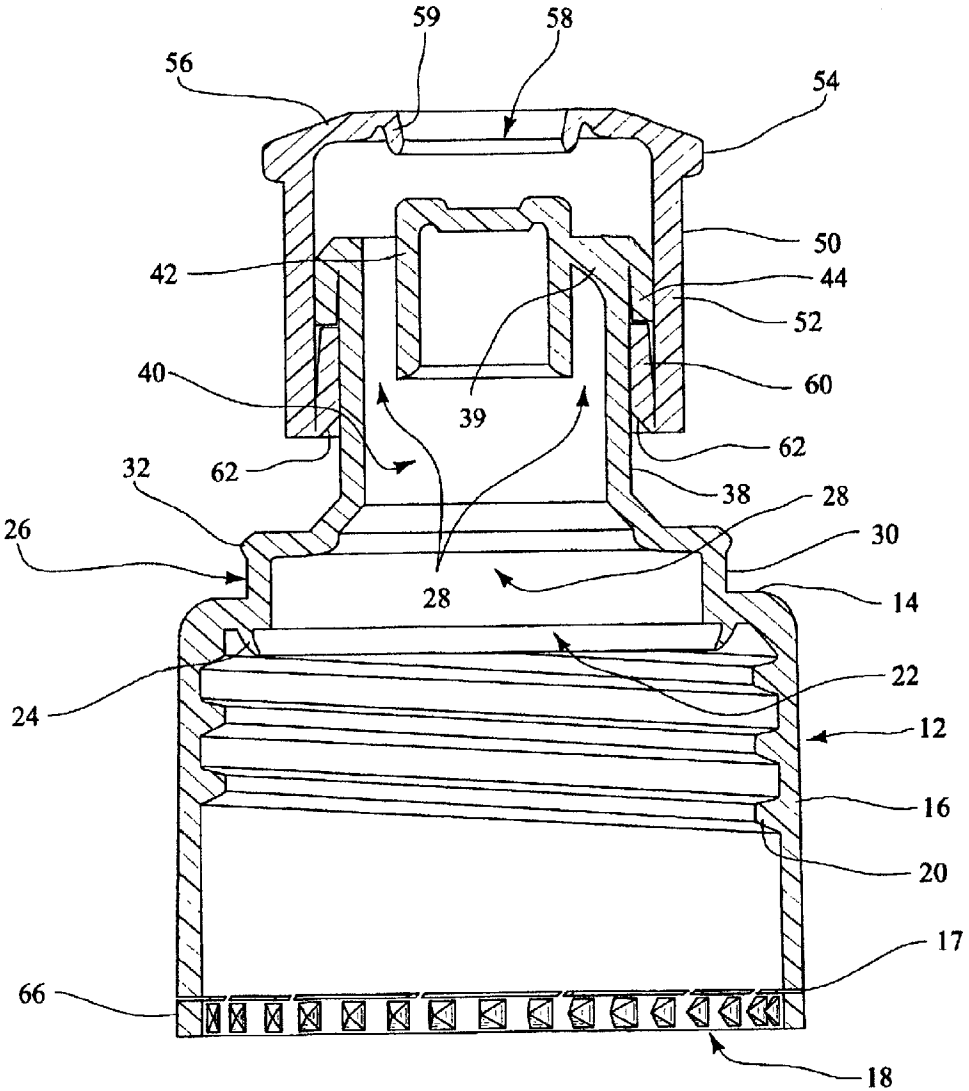
FIG. 4 shows a sectional view of the push-pull dispenser of FIG. 1 in the open position.
Figure 5:
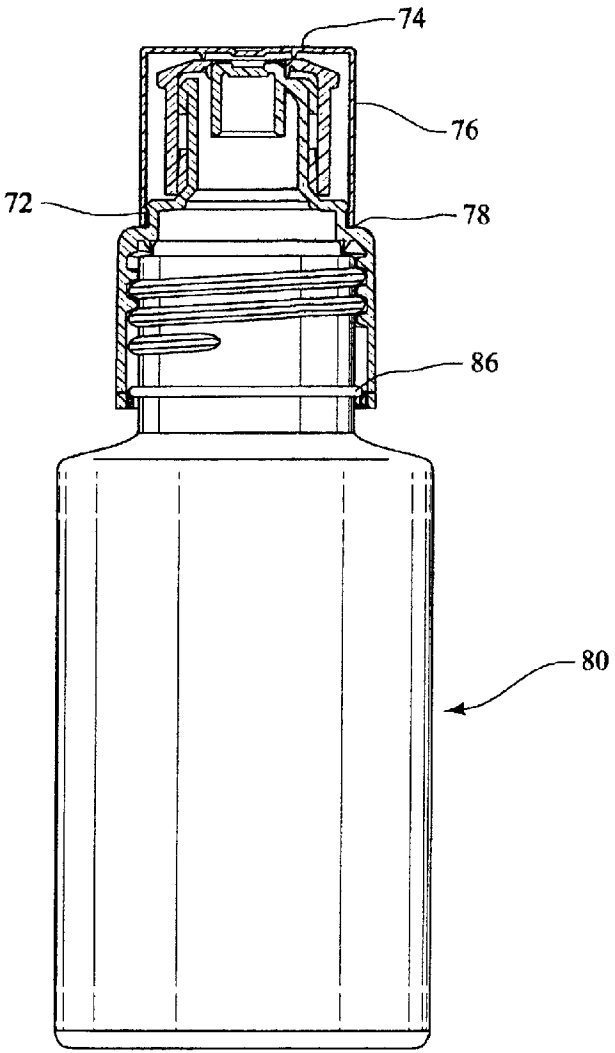
FIG. 5 shows a sectional view of the dispenser and a typical container used with the dispenser.
Figure 6:
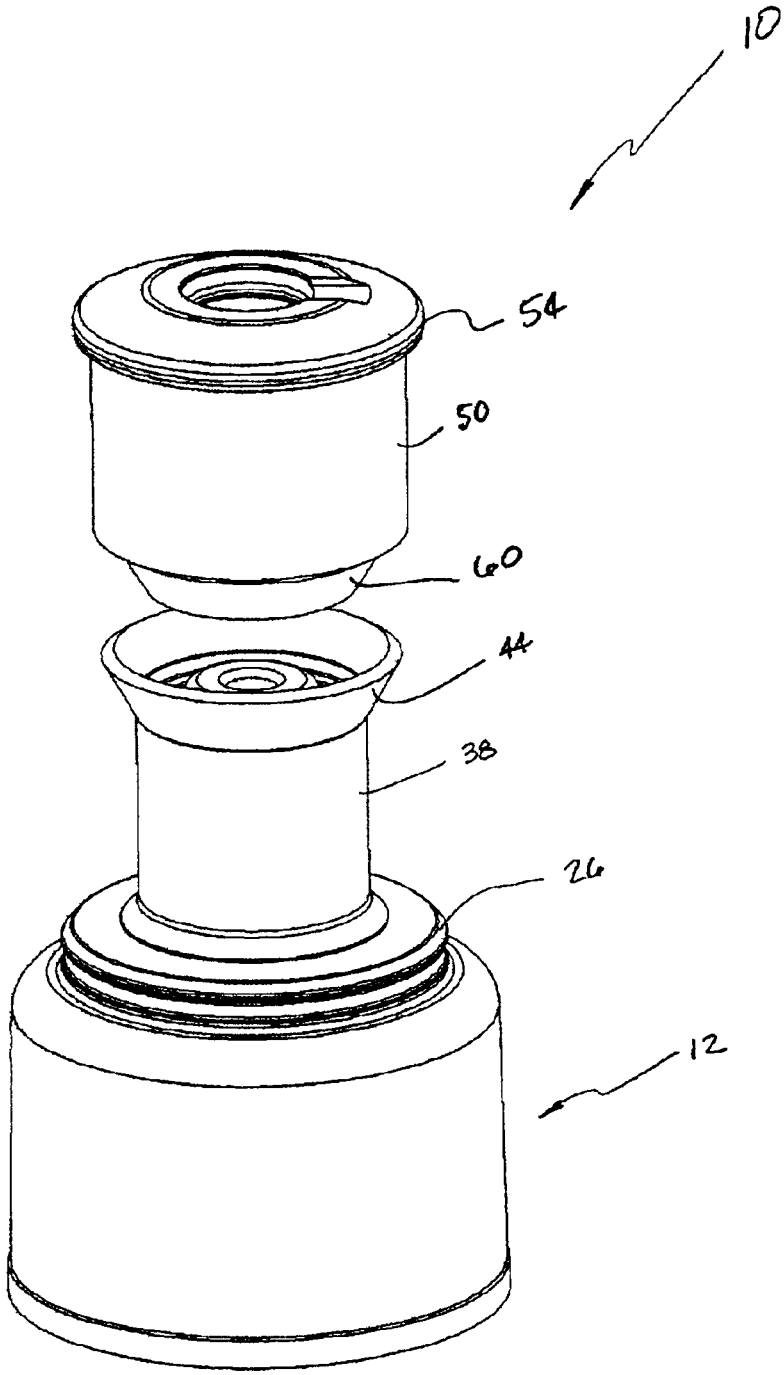
FIG. 6 shows a perspective view of the push-pull dispenser of the present invention having a continuous stem lug and continuous folding finger; and, FIG. 7 shows a perspective view of the push-pull dispenser of the present invention having a plurality of stem lugs and a plurality of folding fingers.

Referring initially to FIGS. 1,3, and 4, a push-pull dispenser 10 of the present invention is shown. According to one embodiment of the instant invention, the dispenser 10 may be formed of some rigid or semi-rigid polymeric material and may be made of polypropylene in an injection molding process. The dispenser 10 comprises a base portion 12 having a base portion top wall 14 and a base portion skirt 16 depending from a peripheral edge of the base portion top wall 14. The base portion 12 is preferably cylindrical in shape with a lower edge 17 defining an opening 18 for placing the dispenser 10 on a container 80. The skirt 16 may have a knurling 19 along an outer surface of the base portion 12 for aid in rotating the dispenser 10 to either an open or closed position. On an inner surface of the skirt 16 may be a helical thread 20 for threadable engagement with the helical thread or neck finish 20 of a container neck 82 as seen in FIG. 5. The neck finish or thread 20 may be of varying pitch and size depending on the intended use, as will be understood by one of ordinary skill in the art. Moreover, the thread 20 may have a plurality of configurations including single helix, double helix, and triple helix or other multiple lead thread design.

Depending from the closure top wall 14 may be a seal 24. The seal 24 may be a plug seal, a reverse taper plug seal, or as depicted in FIGS. 3,4 a folding element seal 24. The folding element seal 24 compressively seals against a container top wall 84 as the dispenser 10 is threadably attached to the container neck 82. Alternatively, a plug seal may be used which sealably engages the container neck.

Within the closure top wall 14 may be a dispensing orifice 22 which is in fluid communication with the container 80 when the dispenser is threadably connected to the neck finish. The dispensing orifice 22 may also be in fluid communication with neck 26. The neck 26 extends circumferentially about the dispensing orifice 22 and extends upwardly having a hollow inner portion therein defining a fluid communication path 28. The neck 26 may have a groove 30 extending circumferentially about the neck 26, as best seen in FIGS. 3,4, which defines a neck bead 32 extending radially outward above the groove 30 and circumscribing the neck 26. The neck bead 32 may operably engage an overcap bead 72 in order to maintain an overcap 70 in a closed position. However, the design of the present invention does not require a neck as the stem may extend to the base portion or the three elements stem, neck, and base may be integrated into a single structure. The inventive aspects described herein are considered to incorporate such alternative designs.

Figure 2:
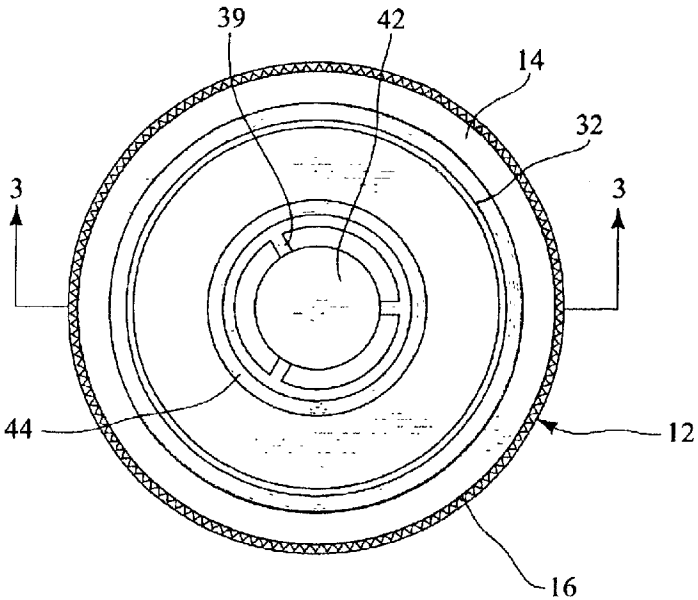
FIG. 2 shows a top view of the push-pull dispenser of FIG. 1.
Figure 7:
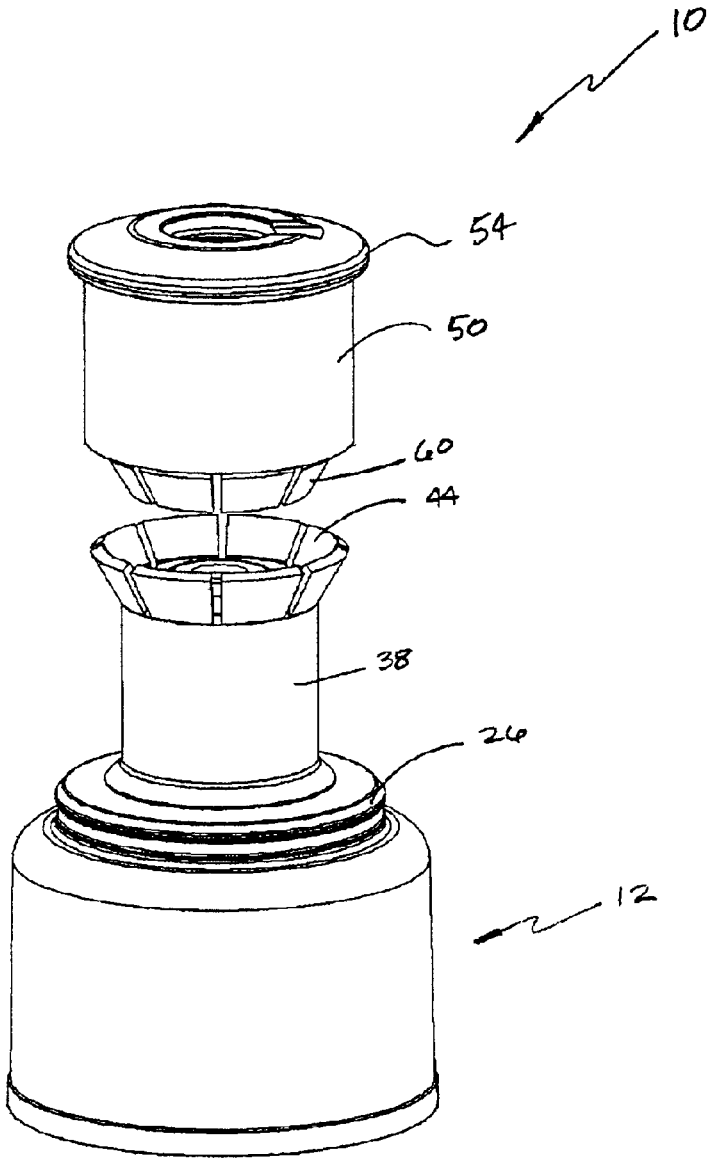

Enclosing the fluid communication path 28 and extending upward from neck 26 is an upstanding stem or body 38. The stem 38 may be substantially cylindrical in shape and has a hollow portion therein further defining the fluid communication path 28. Within the stem 38 is a flow diverter 42 which is connected to the cylindrically shaped inner sidewalls of the stem 38. As shown in FIG. 2, the flow diverter 42 is centrally located in the stem 38 and preferably is connected to the stem 38 by three stem ribs 39 which are spaced apart about 120 degrees. The flow diverter 42 has a diameter less than the inner diameter of the stem 38 such that the fluid communication path 28 is not completely closed. As shown in FIGS. 1 and 7, connected to an upper portion of the stem 38 is at least one stem lug 44 which extends continuously about the circumference of the stem 38. In the alternative, as depicted in FIG. 8, the at least one stem lug 44 may be interrupted by a plurality of slits forming a plurality of stem lugs 44. As shown in FIGS. 3,4, the at least one stem lug 44, when viewed in section, may be constructed of four protrusions, however the at least one stem lug 44 may be a plurality of shapes. The at least one stem lug 44 may be connected to the stem 38 near an upper portion of the stem lug 44. Moreover, the at least one stem lug 44 may be molded as an abutment or protrusion in the position shown or molded as a folding protrusion with folding hinge line in an upwardly extending position and pushed or rotated downward during assembly. The at least one stem lug 44 most preferably has a horizontal lowermost surface which abuts a horizontal surface 61 of a folding finger 60. An upper surface of the at least one stem lug 44 is preferably tapered so that a folding finger 60 of the slidable dispensing cap 50 can more easily pass over the at least one stem lug 44 when the slidable dispensing cap 50 is applied to the stem 38.

Slidably disposed along the stem 38 is a slidable dispensing cap 50. The slidable dispensing cap 50 has a cylindrical sidewall 52 having a slightly larger diameter than the stem 38 and stem lug 44 connected thereto which allows axial vertical sliding of the slidable dispensing cap 50 along the stem 38. Disposed on an upper portion of the sidewall 52 may be a finger rib 54 circumscribing the sidewall 52. The finger rib 54 aids a user in gripping the slidable dispensing cap 50 and moving the cap 50 between a closed and an open position. Extending radially inward from above the finger rib 54 is a cap top wall 56. Centrally disposed in the cap top wall 56 is a cap-dispensing aperture 58. The cap-dispensing aperture 58 is disposed above and aligned with the flow diverter 42. The cap-dispensing aperture 58 may be defined by an annular valve finger 59 but any opening within the cap may suffice. As shown in FIGS. 3,4 the annular valve finger 59 and flow diverter 42 together form a valve wherein vertical movement of the cap 50 either opens or closes the dispensing aperture 58. More specifically, an upward movement of the cap 50 causes the annular valve finger 59 to disengage the flow diverter 42 revealing a fluid path 28 through the cap dispensing aperture 58 while a downward movement causes the annular valve finger 59 to engage the flow diverter 42 closing the fluid path 28 through the cap-dispensing aperture 58.

Hingeably connected along a lower peripheral edge of the slidable dispensing cap 50 may be at least one folding finger 60. The at least one folding finger 60 may be a continuous finger extending about the cap 50 as shown in FIG. 7 or a plurality of folding fingers 60 defined by a plurality of interruptions in the continuous folding finger as shown in FIG. 8. The at least one folding finger 60 has four sides including a hinge line or tapered surface 62. The at least one folding finger 60 also includes an upper horizontal or abutment surface which engages the lower horizontal surface 45 of the stem lug 44. The contact of two horizontal surfaces inhibits outward deflection of the slidable dispensing cap 50 thus preventing the cap 50 from sliding over stem lug 44. The hinge line or tapered surface 62 along with the bevel formed on the outer peripheral edge of the stem lug 44, in combination, allow the folding finger 60 to pass over the stem lug 44 when the cap 50 is applied to the stem 38.

As depicted in FIGS. 1,5 frangibly connected along a lower peripheral edge of the base portion 12 may be a tamper-indicating ring 66. The tamper-indicating ring 66 may engage a container neck bead 86 when the dispenser is placed on a container 80. If the tamper indicating ring 66 is loose or detached a user will be forewarned that the contents of the container 80 may have been tampered with.

Referring now to FIGS. 1,3 an overcap 70 is shown positioned over the slidable dispensing cap 50. The overcap is preferably cup shaped having a top 74 and a cylindrical skirt 76 depending therefrom. The overcap 70 has a lower peripheral edge 78 defining an open end. Adjacent the lower peripheral edge 78 and extending radially inward is an overcap bead 72 which extends around the inner surface of the skirt 76. Along an upper inner surface of the overcap 70 may be an annular rib 80 depending downwardly therefrom. The annular rib 80 may make contact with the slidable dispensing cap 50 so that when the over cap 70 is positioned on the dispenser 10, the slidable dispensing cap 50 may not slide upwardly and leak container contents therefrom.

As shown in FIG. 3, the overcap 70 may be disposed within the groove 30 and beneath the neck bead 32. Preferably, the overcap bead 72 locks beneath the neck bead 32 to maintain the overcap 70 on the base portion 12 over the slidable dispensing cap 50.

In use the dispenser 10 is preferably formed in an injection molding process. The base portion 12, the neck 26, and the stem 38 are formed in a first injection molding process while the slidable dispensing cap 50 and overcap 70 may be formed in separate processes. The hingeably connected at least one folding finger 60 is pushed upward against the inner portion of the sidewall 52. The lower tapered surface of the at least one folding finger 60 is positioned against the upper tapered surface of the at least one stem lug 44 and pushed downward over the at least one stem lug 44. The hinged connection of the at least one folding finger 60 to the sidewall 52 allows the sidewall 52 to flex outwardly and over the at least one stem lug 44. Once the at least one folding finger 60 is disposed below the at least one stem lug 44, the slidable dispensing cap 50 may be moved between an upper open position and a lower closed position. In the upper open position the annular valve finger 59 disengages the flow diverter 42 opening the fluid communication path 28 from a container through the cap dispensing aperture 58. In the lower closed position, the annular valve finger 59 engages the flow diverter 42 to close the fluid communication path 28 through the cap dispensing aperture 58. However, once the slidable dispensing cap 50 is on the stem 38, the upper horizontal surface of the folding finger 60 contacts the lower horizontal surface of the at least one stem lug 44. Since the two contacting surfaces are horizontal, there is no outward force caused by angled surface contact and no resultant force causing outward deflection of the slidable dispensing cap 50.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

I claim:

1. A push-pull dispenser, comprising:

a base portion having a base portion top wall and a cylindrical base portion skirt depending from an outer peripheral edge of said top wall, said skirt having a lower edge defining an opening, and a dispensing orifice centrally disposed in said base portion top wall defining a fluid path between said base portion and an upwardly extending neck;

a neck extending upwardly from said base portion top wall and being integral therewith, said neck being hollow and further defining said fluid path in communication with said base portion and an upwardly extending stem;

said upwardly extending stem being in fluid communication with said neck and said dispensing orifice;

a flow diverter centrally disposed in said stem;

at least one stem lug extending circumferentially about an upper outer portion of said stem and extending downwardly therefrom;

said at least one stem lug having at least one lower horizontal surface;

a slidable dispensing cap having a top wall, a cylindrical sidewall depending from a peripheral edge of said top wall, and at least one folding finger hingeably connected to a lower peripheral edge of said sidewall, said folding finger having an upper horizontal surface which abuts said lower horizontal surface of said at least one stem lug;

said top wall of said slidable dispensing cap having a centrally disposed cap-dispensing aperture and an annular valve finger which sealably engages said flow diverter.

2. The push-pull dispenser of claim 1, said base portion further comprising a helical thread along an inner surface of said base portion skirt.

3. The push-pull dispenser of claim 1, said base portion top wall further comprising a seal depending therefrom.

4. The push-pull dispenser of claim 1, said at least one stem lug having an upper tapered surface.

5. The push-pull dispenser of claim 1, said folding finger having a lower tapered surface operably engaging an upper tapered surface of said at least one stem lug.

6. The push-pull dispenser of claim 1, further comprising a frangibly connected tamper indicating ring depending from a lower edge of said base portion.

7. A push-pull dispenser, comprising:

a base portion and an upwardly extending stem from a base portion top wall;

at least one stem lug depending from an upper exterior portion of said stem;

a slidable dispensing cap being slidably disposed over said stem having at least one folding finger connected thereto;

said at least one folding finger having an upper horizontal surface operably engaging said at least one stem lug.

8. The push-pull dispenser of claim 7 further comprising a helical thread disposed on a skirt depending from a peripheral edge of said base portion top wall.

9. The push-pull dispenser of claim 7 further comprising a seal depending from said base portion top wall.

10. The push-pull dispenser of claim 7 further comprising a neck extending between said base portion top wall and said stem, said neck having a hollow portion defining a fluid path through a dispensing orifice and said stem.

11. The push-pull dispenser of claim 10 further comprising a neck bead defining an annular groove around said neck.

12. The push-pull dispenser of claim 7 further comprising a flow diverter centrally disposed within said stem.

13. The push-pull dispenser of claim 7, said stem lug including an upper tapered surface and a lower horizontal surface.

14. The push-pull dispenser of claim 7 further comprising an overcap being substantially cup-shaped and disposed over said neck.

15. The push-pull dispenser of claim 7, said folding fingers including a lower tapered surface and an upper horizontal surface.

16. The push-pull dispenser of claim 7, said slidable dispensing cap further comprising a centrally disposed cap-dispensing aperture defined by an annular valve finger, said annular valve finger engaging a flow diverter centrally disposed in said stem.

17. A push-pull dispenser, comprising:

a base portion having a base portion top wall, a skirt depending from a peripheral edge of said base portion top wall, said skirt including a helical thread circumferentially extending along an inner surface of said skirt;

said base portion top wall having a dispensing orifice centrally disposed therein;

an upwardly extending stem defining a fluid communication path;

at least one stem lug formed on an upper portion of said at least one stem, said stem lug having a horizontal lower surface;

a flow diverter centrally disposed in said stem;

a slidable dispensing cap having a top wall, a skirt depending from a peripheral edge of said top wall and having a centrally disposed cap dispensing aperture;

at least one folding finger depending from an inner surface of said slidable dispensing cap;

said slidable dispensing cap also having a finger rib circumferentially extending around an upper portion of said slidable dispensing cap; and, an annular valve finger depending from said cap top wall and operably engaging said flow diverter.

18. The push-pull dispenser of claim 17, further comprising a neck bead disposed about a neck and defining a groove.

19. The push-pull dispenser of claim 17, further comprising an overcap having an overcap bead and disposed over said slidable dispensing cap and stem.

20. A push-pull dispenser, comprising:

a base portion having an upwardly extending stem;

a slidable dispensing cap slidably disposed over said stem;

said stem having a stem lug;

said slidable dispensing cap having at least one folding finger hingeably connected to a lower edge thereof, said at least one folding finger having an upper horizontal surface for engaging said stem lug;

said stem having a centrally disposed flow diverter axially aligned with and operably engaging an annular valve finger defining a cap dispensing aperture.

21. A push-pull dispenser, comprising:

a base portion and an upwardly extending stem;

said stem having at least one stem lug on an outer peripheral surface, said at least one stem lug having a lower contacting surface;

a slidable dispensing cap axially aligned with and disposed over said stem, said slidable dispensing cap having at least one folding finger along a lower peripheral edge, said at least one finger having a contacting surface engaging said contacting surface of said stem lug.

* * * * *